United States Patent [19]

Eiteljorg, II

[11] 4,008,790

[45] Feb. 22, 1977

[54] CAMERA AND LENS CASE

[76] Inventor: Harrison Eiteljorg, II, 142 Grays Lane, Haverford, Pa. 19041

[22] Filed: Aug. 26, 1975

[21] Appl. No.: 607,943

[52] U.S. Cl. ..... 190/44; 190/52

[51] Int. Cl.² ..... A45C 11/38

[58] Field of Search ..... 190/21, 28, 44, 49, 190/50, 51, 52; 220/4 C; 150/52 J

[56] References Cited

UNITED STATES PATENTS

| | | | |
|---|---|---|---|
| 1,101,357 | 6/1914 | Thompson | 190/21 |
| 1,149,266 | 8/1915 | Johnson | 190/21 |
| 1,950,118 | 3/1934 | Lifton | 190/44 |
| 2,875,868 | 3/1959 | Powell | 190/44 |
| 3,728,003 | 4/1973 | Bohannon | 190/44 X |
| 3,912,055 | 10/1975 | Malooly | 190/52 |

*Primary Examiner*—Donald F. Norton

*Attorney, Agent, or Firm*—Howson and Howson

[57] ABSTRACT

A camera and lens case comprises a box-like structure including an upper lens storage compartment and a lower camera body storage compartment. The upper compartment is hingedly attached for 180° rotation with respect to the lower compartment and serves as the top closure member therefor. Access may be gained to the upper compartment either by means of a hinged lid, or, alternately, when the compartment is rotated 180° into an inverted disposition with the lid closed, by opening a hinged bottom panel thereof, permitting simultaneous access to both the upper and lower compartments. The lower compartment may be expanded or contracted in size by the selective addition or removal of insert sections.

3 Claims, 10 Drawing Figures

CAMERA AND LENS CASE

BACKGROUND OF THE INVENTION

The present invention relates generally to carrying cases for optical instruments and relates more particularly to a novel camera and lens case especially suited for the needs of the professional photographer.

The professional photographer's traveling equipment includes at least one camera body and a plurality of interchangeable lenses of different focal lengths. Although various types of cases have been proposed for carrying such equipment, there are essentially two types which have attained widespread usage. A first type comprises a shallow suitcase-like container wherein the camera body and lenses are each individually fitted into compartments or cavities, usually cut out of a semi-rigid plastic foam. A disadvantage of this type case is that the entire case must be opened to obtain any one item. Furthermore, there is little flexibility in the arrangement of the items once the initial setup has been established, and there is no provision for expansion should additional equipment be acquired.

The second type of camera case in common use by professional photographers comprises a top-opening rectangular box of substantial depth, usually formed of aluminum. Receptacles are generally provided within the box to secure the camera body and lenses which are apt to be disposed one above the other. The contents of the case must often be rearranged to reach the desired item, and, as with the previously described case, there is no provision for expansion.

In U.S. Pat. No. 2,837,096, issued Mar. 18, 1958, a case is described in which an upper compartment, which might be used to store lenses, is accessible through the case lid, while the entire compartment is hinged and pivoted to gain access to a lower larger compartment suitable for storage of a camera body. This case, although an improvement over the above described cases in that the frequently opened lens compartment is isolated from the infrequently opened camera body compartment, does not permit the lens compartment and camera compartment to be opened simultaneously. This patented case had no provision for expansion should additional storage room be required in the camera body compartment.

SUMMARY OF THE INVENTION

The present case includes an upper lens storage compartment and a lower camera body storage compartment with the upper compartment being hingedly attached for 180° rotation with respect to the lower compartment and serving as the top closure member therefor. With the upper compartment in the normal closed position, access is gained thereto by means of a hinged lid. With the upper compartment rotated into the inverted position, access may be gained thereto through a hinged bottom panel thereof which preferably opens away from the lower compartment. The upper and lower compartments may thus be open in side-by-side relation at the same time to allow the selection of a camera body and lens. With the upper compartment rotated into the closed position over the lower compartment, the opening of the lid permits the ready changing of the camera lens without opening the lower compartment.

The present case may be expanded to accommodate larger equipment, for example, the addition of a motor drive to the camera body. This is accomplished by the insertion of a frame-like section in the lower compartment which is divisible for this purpose along a horizontal joint. Insert sections of different sizes or a plurality of insert sections may be used to produce the desired case depth.

It is accordingly a first object of the present invention to provide a novel camera and lens case having separate lens and camera body compartments which may be opened independently or, if desired, at the same time with side-by-side access to each compartment.

A further object of the invention is to provide a camera and lens case as described wherein an upper lens compartment comprises the closure member for a lower camera body compartment and wherein the lens compartment may be opened either by means of a lid on the top thereof, or, when inverted, by means of a hinged bottom panel.

A further object of the invention is to provide a camera and lens case as described which may be selectively varied in depth by the addition or removal of insert sections between divisible portions of the camera body compartment.

Another object of the invention is to provide a camera and lens case having the features described which is of a relatively simple construction and which may be economically manufactured.

DESCRIPTION OF THE PREFERRED EMBODIMENT

Figure 3:
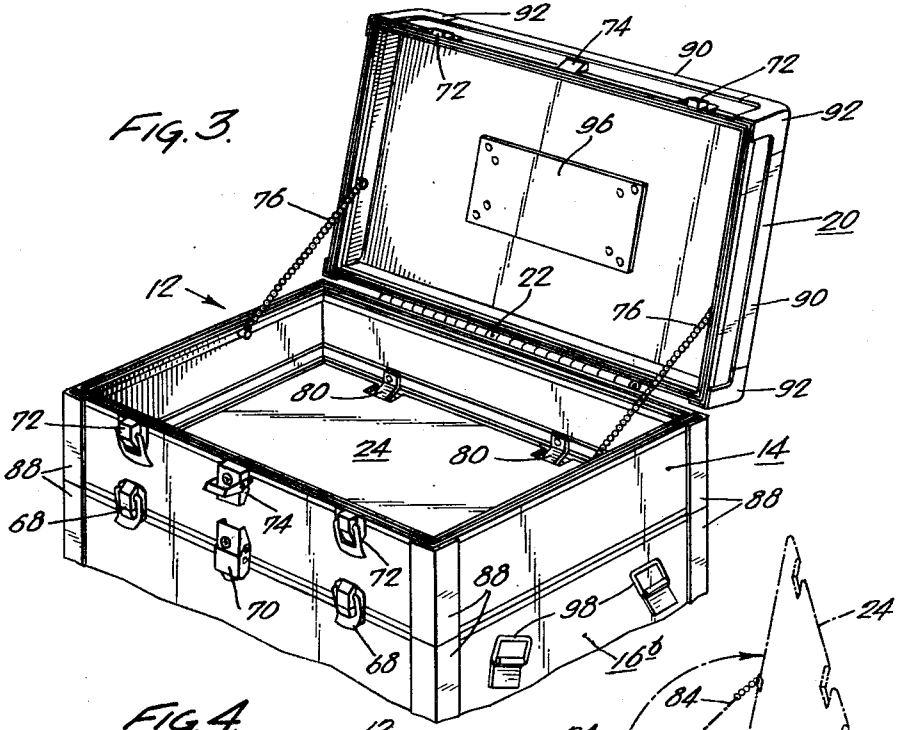
FIG. 3 is a partial perspective view similar to FIG. 1 but showing the lid of the case in the open position.

Referring to the drawings and particularly FIGS. 1–5 thereof, the present camera and lens case generally designated 12 comprises a box-like structure of a size and weight suitable for carrying a camera body and a plurality of interchangeable lenses therefor. As indicated, the case has been designed for the professional photographer to minimize the time and effort required in initially removing the camera body and the desired lens from the case, the changing of lenses, and the return of the camera body and lens to their respective compartments. To permit an early understanding of the function of the case components, the case will first be described in general terms with a more detailed description to follow.

Figure 4:
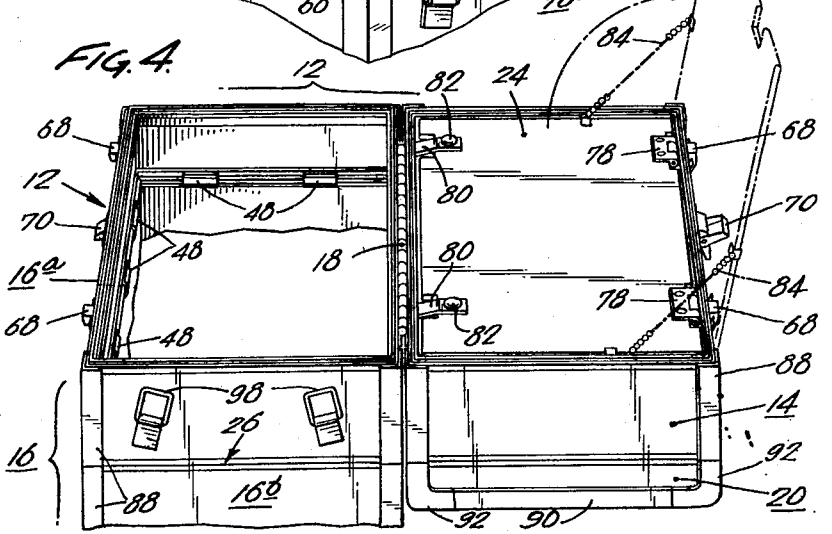
FIG. 4 is a partial end perspective view of the case showing the upper lens compartment in the open inverted position and, in broken lines, the hinged bottom thereof also in an open position.
Figure 1:
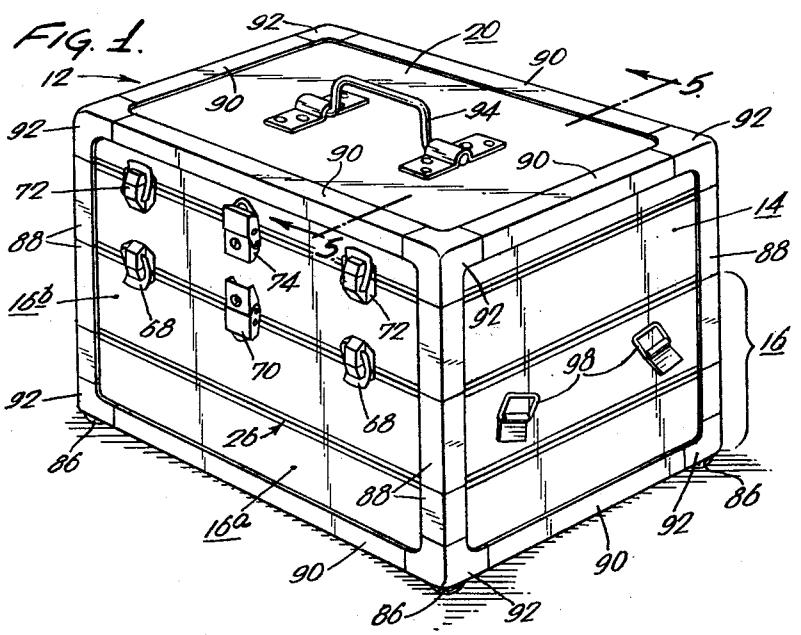
FIG. 1 is a perspective view of a camera and lens case in accordance with the present invention showing the front, top and one side thereof.
Figure 2:
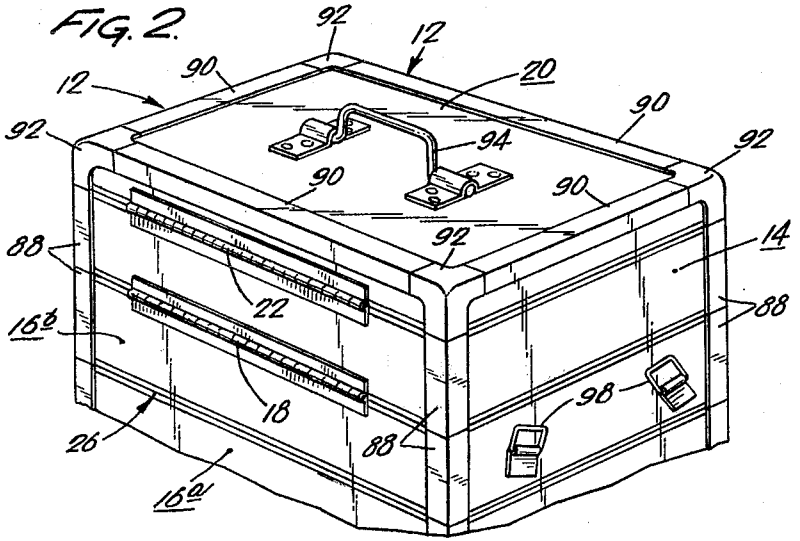
FIG. 2 is a partial perspective view of the case shown in FIG. 1 showing the rear, top and the opposite side thereof.
Figure 7:
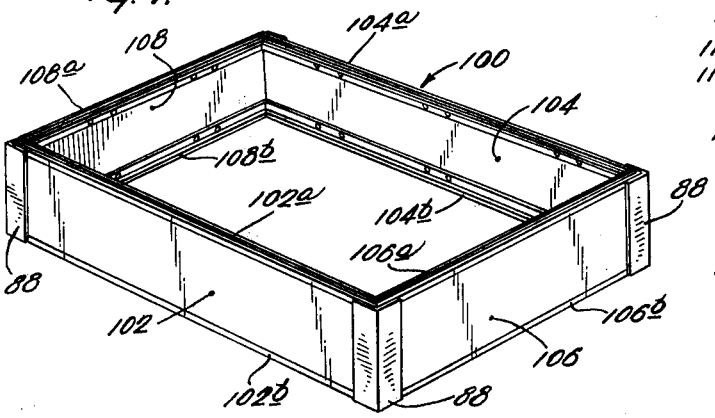
FIG. 7 is a perspective view of the insert section added to the case in FIG. 6.

The case 22 is divided into an upper lens compartment 14 and a lower camera body compartment 16 with the lens compartment serving as the top closure member for the camera body compartment. As shown in FIGS. 2 and 4, the lens compartment 14 is connected by a hinge 18 to the lower compartment 16 and may be pivoted 180° with respect thereto from a closed position as illustrated in FIG. 1 to the open position shown in FIG. 4. With the lens compartment in the closed position as illustrated in FIG. 3, access may be gained thereto by means of a lid 20 pivotally connected thereto by a hinge 22. With the lid closed and the lens compartment swung 180° into the position shown in FIG. 4, access may alternately be gained to the lens compartment through a hinged bottom panel 24 thereof as illustrated in the broken line portion of the view. For the initial set-up of the camera, the camera body may thus be removed from the lower compartment 16 and a lens selected from the lens compartment 14 while both compartments are in open, side-by-side relation. Following the closure of the lens compartment bottom panel 24 and the pivotal movement of the lens compartment to the closed position, access may be gained through the lid 20 to permit the rapid changing of the camera lens without disturbing or exposing the contents of the lower compartment 16. The lower compartment 16 is divisible along a horizontal joint 26 to permit the addition of one or more frame-like sections as shown in FIG. 7 to selectively increase the depth of the lower compartment.

Figure 5:
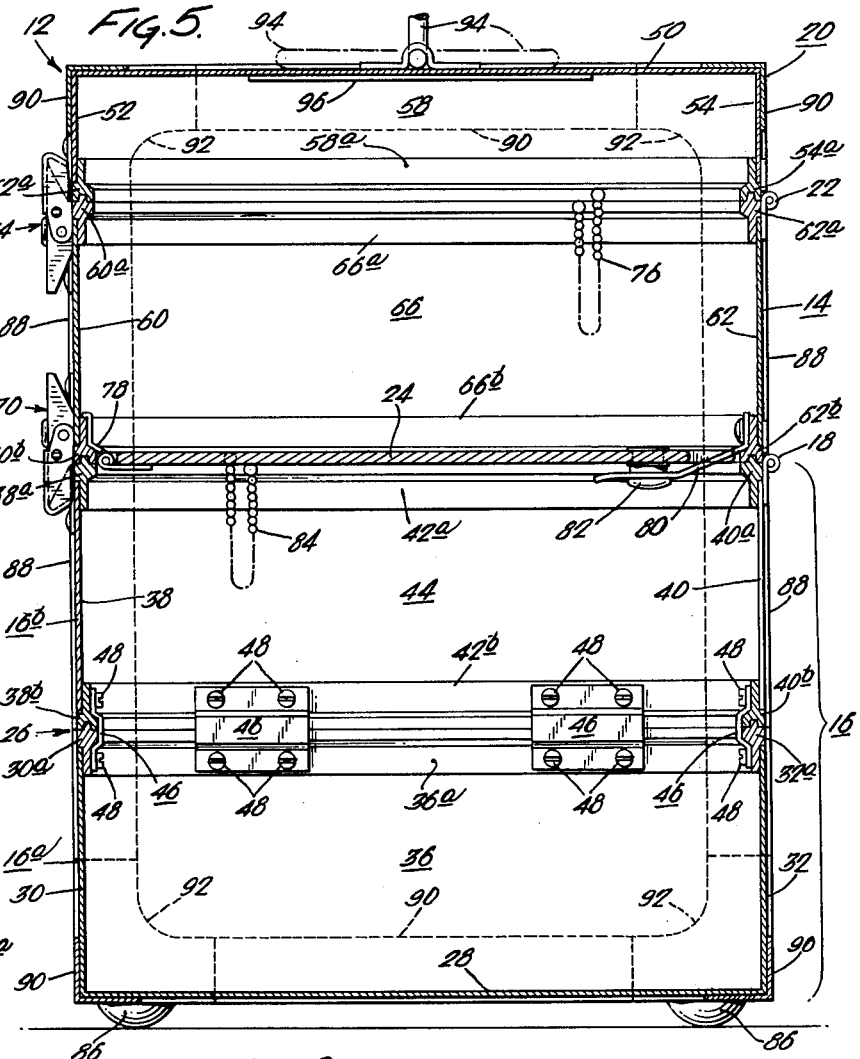
FIG. 5 is a transverse sectional view taken along line 5—5 of FIG. 1.

Considering the details of construction of the illustrated embodiment, and with particular reference to the sectional view of FIG. 5, it can be seen that the case 12 is fabricated from sheet metal panels, preferably aluminum, which are stiffened by means of extruded strips, also preferably aluminum, along their exposed edges. A lower section 16a of the lower compartment includes a bottom panel 28 which is formed integrally with a front panel 30, rear panel 32 and side panels 34 and 36. The upper edges of the upstanding panel portions are bonded to extrusion strips 30*a*, 32*a*, 34*a* and 36*a* respectively. Each panel edge is seated in flush relation in a groove of the extrusion strip and is bonded thereto in any suitable fashion such as by means of an adhesive.

An upper section 16*b* of the lower compartment 16 is similarly formed of front, rear and side panels 38, 40, 42 and 44 which are respectively attached with their upper and lower edges to extrusion strips 38*a* and *b;* 40*a* and *b;* 42*a* and *b;* and 44*a* and *b*. The extrusion strips around the lower edges of the upper section 16*b* interact in tongue and groove relation with the extrusion strips of the upper edge of the lower section 16*a* to provide a dust-tight sealing of the joint 26. Plates 46 contoured to fit the cooperating extrusion strips are secured thereto by screws 48 and serve to hold the two sections of the lower compartment together.

The upper compartment 14 including the lid 20 are formed in a manner identical with that described with respect to the lower compartment. The lid 20 comprises a top panel 50 having integral downwardly formed front, rear and side panel portions 52, 54, 56 and 58 respectively. Extrusion strips 52*a*, 54*a*, 56*a* and 58*a* are bonded to the lower edges of the panel portions 52, 54, 56 and 58.

Similarly, the upper compartment 14 is formed by front panel member 60, rear panel member 62 and side panel members 64 and 66 which are each respectively provided with upper and lower extrusion strips 60*a*, 60*b*, 62*a*, 62*b*, 64*a*, 64*b* and 66*a*, 66*b*. The extrusion strips fit in tongue and groove relation with the adjoining extrusion strips of the lid above and the lower compartment below to provide a dust-tight sealing of the case.

As indicated above, the upper compartment 14 is pivotally attached to the lower compartment 16 by the hinge 18 which may be attached in any suitable manner to the extrusion strips 40*a* and 62*b* such as by bolts, rivets, etc. Similarly, the lid 20 is pivotally attached by the hinge 22 to the upper compartment 14.

To secure the upper compartment 14 is the closed position above the lower compartment 16, latches 68 and a lock 70 are provided on the front of the case. Similarly, to secure the lid in the closed position on the upper compartment 14, latches 72 and a lock 74 are provided. A safety device may be included as described below to prevent the locks 70 and 74 from both being opened at the same time. Chains 76 as shown in FIG. 3 support the top 20 in the open position when the top has reached an overcenter position.

The bottom panel 24 of the upper compartment 14 is pivotally mounted by hinges 78 to the extrusion strip 60*b*. In its normal position, the bottom panel 24 is secured in place by a pair of straps 80 which are affixed to the extrusion strip 62*b* at one end and provided with snap fasteners 82 at the other end to permit selective detachment from the bottom panel 24. Chains 84 at each side of the bottom panel limit its opening movement to a slightly over-center position as illustrated in FIG. 4.

For protection of the case, feet 86 are provided at the bottom corners thereof and protective strips 88 and 90 are respectively provided along the vertical and horizontal edges of the case. The strips 88 and 90 fit flushly against corner reinforcements 92 and prevent damage to the thin sheet metal edges as well as furnish a decorative appearance to the case.

A handle 94 is attached to the top of the case, being secured thereto by rivets or other fastenings passing through a reinforcing plate 96 inside the top panel 50. In addition, anchor members 98 are attached to each side of the case for attachment of a shoulder strap (not shown) which may be used in addition to the handle 94 for transporting the case.

Figure 6:
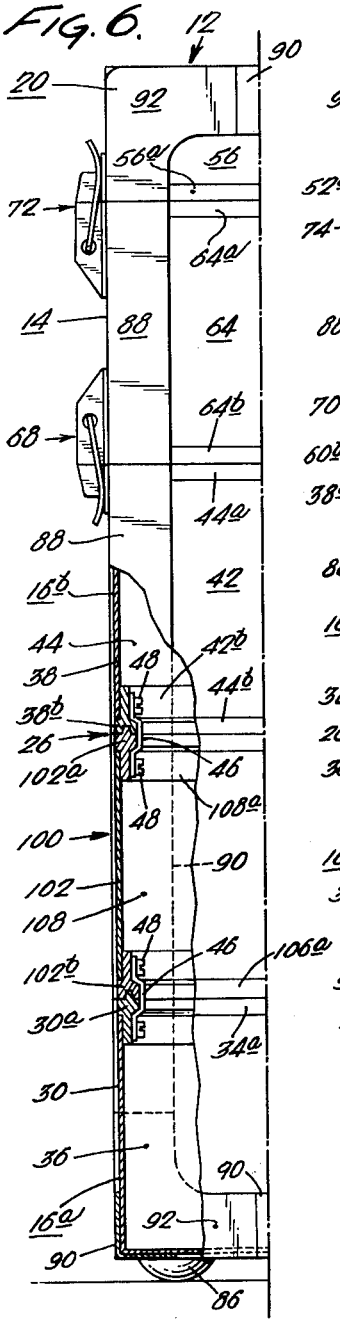
FIG. 6 is a partial end view partly broken away and in section showing the case with an insert section added to the lower compartment to increase the depth thereof.

With reference to FIGS. 6 and 7, an insert section generally designated 100 is illustrated which may be added to the lower compartment 16 by opening the compartment along the joint 26. The plates 46 are removed to permit separation of the lower compartment sections 16*a* and 16*b* and a second set of the plates is employed as shown in FIG. 6 to secure the insert section 100. The construction of the insert section is identical to that of the rest of the case, for example the upper section 16b of the lower compartment 16. The section 100 includes front, rear and side panels respectively 102, 104, 106 and 108 to which are secured the extrusion strips 102*a* and *b*, 104*a* and *b*, 106*a* and *b*, and 108*a* and *b* at the upper and lower edges respectively. Protective strips 88 are provided along the vertical corner edges as with the other components of the case.

The operation of the case as indicated above is simple and efficient. For the initial set up of the camera, the lock 70 is opened along with the latches 68 and the upper compartment is pivoted 180° into the inverted position shown in FIG. 4. The bottom panel 24 is then opened by release of the snap fasteners 82 and is swung open into the dotted line position of FIG. 4 where it is held by the chains 84. The camera body may then be removed from the lower compartment and a lens selected from the upper compartment for coupling thereto. This procedure is reversed to return the camera and lens to the case for storage. If a change of lens is desired after the case has been closed, access may be quickly gained to the upper compartment simply by opening the lock 74 and latches 72 and swinging the lid 20 to the open position as shown in FIG. 3.

The interior of the case is preferably lined with a soft, resilient padding which may be of foam, rubber or other suitable material. The showing of such a lining has been omitted from the drawings since it would obscure the construction details of the case. Similarly, both the upper and lower compartments may be fitted with partitions or receptacles to secure the camera components and lenses in a fixed disposition and prevent their movement during transport of the case. Any partitions used in the upper compartment must be open at both the top and the bottom to permit removal of their contents in either the open or closed position of the upper compartment.

Although the construction of the illustrated embodiment is of sheet metal, it will be apparent that a case incorporating the present invention could be fabricated from molded plastic, wood or any other suitable material. Furthermore, the size and shape of the case may be varied as desired. Although the rectangular shape illustrated is preferred to maximize the space within the case, the corners of the case may obviously be rounded either for aesthetic reasons or to facilitate the molding of the case sections from plastic materials.

Figure 10:
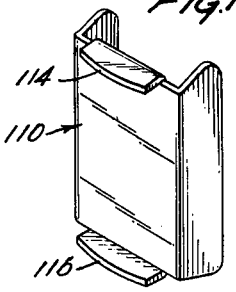
FIG. 10 is a perspective view showing the slide element of the safety device of FIGS. 8 and 9.
Figure 9:
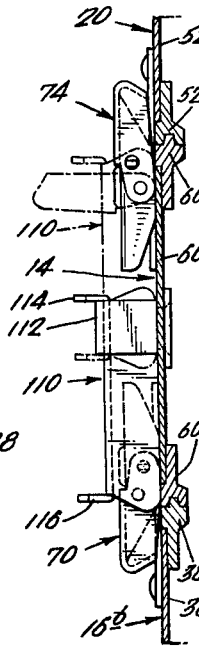
FIG. 9 is a sectional view taken along line 9—9 of FIG. 8.
Figure 8:
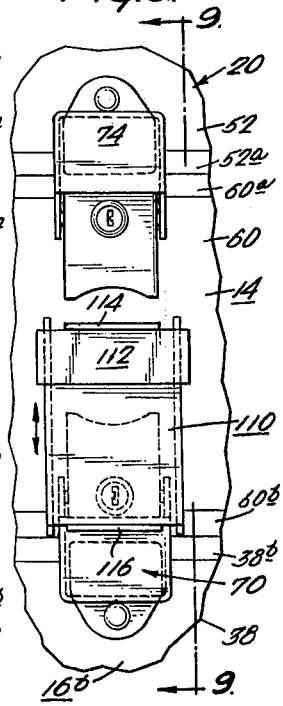
FIG. 8 is a partial front view of the case showing an optional safety device for preventing the simultaneous opening of both the lid and the upper compartment.

In FIGS. 8–10 a safety device is illustrated for preventing the accidental simultaneous opening of both the locks 70 and 74. This device includes a slide element 110 having a U-shaped sectional configuration as illustrated in FIG. 10 which is adapted to slide vertically within a U-shaped guide member 112 attached to the front panel 60 midway between the locks 70 and 74. Upper and lower tangs 114 and 116 on the slide element 110 limit the movement of the slide element by engagement with the guide 112.

As shown in FIGS. 8 and 9, with the slide element in its lowermost position with the tang 114 engaging the upper edge of guide 112, the slide element covers the lock 70 and prevents opening of the lock while the lock 74 is clear and may be freely opened. With the slide element in its uppermost position as illustrated by broken lines in FIG. 9, the tang 116 engages the bottom of the guide element 112. The lock 74 is then covered while the lock 70 may be freely opened. The use of this safety device would prevent the inadvertent movement of the upper compartment to the inverted position shown in FIG. 4 while the lid 20 was unlocked.

Manifestly, changes in details of construction can be effected by those skilled in the art without departing from the spirit and scope of the invention.

I claim:

1. A camera and lens case comprising a box-like structure including front, rear, side and bottom panel members defining a lower compartment, front, rear, side and bottom panel members defining an upper compartment, the lower edge of the rear panel member of said upper compartment being hingedly connected to the upper edge of the rear panel of said lower compartment to permit the 180° rotation of said upper compartment into an inverted position, said bottom panel member of said upper compartment being hingedly attached to the lower edge of the front panel member of said upper compartment, means for selectively securing the rear edge of said upper compartment bottom panel member to the lower edge of the rear panel member of said upper compartment, said upper compartment bottom panel member being adapted for opening upwardly to provide access to said upper compartment when said upper compartment is rotated into the inverted position, a lid pivotally attached to the upper edge of the rear panel member of said upper compartment, means for selectively locking said lid in a closed position with respect to said upper compartment to form the top closure means thereof, means for locking said upper compartment in a closed position with respect to said lower compartment to form the top closure means therefor, said front, rear and side panel members of said lower compartment being divisible along a joint lying in a plane parallel with said bottom panel member thereof to form upper and lower sections of said lower compartment, an insert section adapted for insertion between said divisible lower compartment sections to extend the depth of said lower compartment, and means for selectively and demountably securing together said upper and lower or said upper, insert and lower section of said lower compartment.

2. The invention as claimed in claim 1 including means for preventing the simultaneous opening of said locking means of said lid and said locking means of said upper compartment.

3. A camera and lens case comprising a box-like structure including front, rear, side and bottom panel members, and a top closure member defining a closed compartment, said front, rear and side panel members being divisible along a joint lying in a plane parallel with said bottom panel member to form upper and lower sections of said compartment, an insert section adapted for insertion between said divisible compartment sections to extend the depth of said compartment, and means for selectively and demountably securing together said upper and lower or said upper, insert and lower sections, said means comprising a plurality of plates disposed within said compartment, and fastening means for securing said plates to the adjoining sections of said compartment.

* * * * *